US005248866A

United States Patent [19]

Tanaka et al.

[11] Patent Number: 5,248,866

[45] Date of Patent: Sep. 28, 1993

[54] INDUCTION HEATING COOKER WITH PHASE DIFFERENCE CONTROL

[75] Inventors: Teruya Tanaka; Yutaka Matusmoto, both of Yokohama, Japan

[73] Assignee: Kabushiki Kaisha Toshiba, Kawasaki, Japan

[21] Appl. No.: 545,066

[22] Filed: Jun. 29, 1990

[30] Foreign Application Priority Data

Jun. 30, 1989 [JP] Japan ..... 1-166989

[51] Int. Cl.[5] ..... H05B 6/06

[52] U.S. Cl. ..... 219/10.77; 219/10.493; 363/97

[58] Field of Search ..... 219/10.77, 10.493; 363/79, 80, 96, 97

[56] References Cited

U.S. PATENT DOCUMENTS

| | | | |
|---|---|---|---|
| 3,718,852 | 2/1973 | Bailey | 219/10.77 |
| 4,112,286 | 9/1978 | Alderman et al. | 219/10.77 |
| 4,280,038 | 7/1981 | Havas et al. | 219/10.77 |
| 4,385,348 | 5/1983 | Wisner | 219/10.77 |
| 4,736,082 | 4/1988 | Matsuo et al. | 219/10.77 |
| 4,810,847 | 3/1989 | Ito | 219/10.77 |
| 4,820,891 | 4/1989 | Tanaka et al. | 219/10.77 |

FOREIGN PATENT DOCUMENTS

| | | |
|---|---|---|
| 59064 | 9/1982 | European Pat. Off. . |
| 178852 | 4/1986 | European Pat. Off. . |
| 2836610 | 3/1980 | Fed. Rep. of Germany . |
| 2199454 | 7/1988 | United Kingdom . |

OTHER PUBLICATIONS

K. Mauch, "Transistor Inverters for Medium Power Induction Heating Applications", 1986 IEEE Industry Applications Society Annual Meeting, Part 1, Oct., 1986, pp. 555-562.

*Primary Examiner*—Philip H. Leung

*Attorney, Agent, or Firm*—Foley & Lardner

[57] ABSTRACT

An induction heating cooker comprises an inverter circuit. The inverter circuit has a heating coil and a resonance capacitor that resonates with the heating coil to generate high-frequency electric power with which an object to be heated is inductively heated. The cooker further includes a phase comparator for comparing the phase of a first signal that correlates to the phase of an output voltage of the inverter circuit with the phase of a second signal that correlates with the phase of a current flowing to the resonance capacitor; a phase difference setter for setting the phase difference of the first and second signals; and a frequency controller for controlling an oscillation frequency of the inverter circuit according to a signal from the phase difference comparator to establish the phase difference set by the phase difference setter.

7 Claims, 18 Drawing Sheets

INVERTER VOLTAGE

INVERTER CURRENT

VOLTAGE

OUTPUT OF PHASE COMPARING CIRCUIT

FIG.11a

HEATING COIL OF 21.5 TURNS — RESONANCE CAPACITOR 1 ($\mu$F)

| OBJECT TO BE HEATED | ENAMELED PAN (20cm) | ENAM-ELED KETTLE | ENAM-ELED PAN (12cm) | THREE-LAYERED STEEL PAN | MAG-NETIC PAN | 18.8 STAIN-LESS STEEL | STAIN-LESS STEEL 304 | NON-MAG-NETIC PAN | NON-MAG-NETIC KETTLE | COPPER PAN |
|---|---|---|---|---|---|---|---|---|---|---|
| INDUCTANCE ($\mu$H) | 38.87 | 38.24 | 47.29 | 34.68 | 43.07 | 28.78 | 27.34 | 27.54 | 29.76 | 25.14 |
| RESISTANCE ($\Omega$) | 1.71 | 1.78 | 1.51 | 1.69 | 2.17 | 1.43 | 1.27 | 1.04 | 1.39 | 0.19 |
| f0(KHz) | 25 | 25.7 | 23.1 | 27.0 | 24.3 | 29.7 | 30.4 | 30.3 | 29.2 | 31.7 |

FIG.11b

HEATING COIL OF 30 TURNS — RESONANCE CAPACITOR 0.55 ($\mu$F)

| OBJECT TO BE HEATED | ENAMELED PAN (20cm) | ENAM-ELED KETTLE | ENAM-ELED PAN (12cm) | THREE-LAYERED STEEL PAN | MAG-NETIC PAN | 18.8 STAIN-LESS STEEL | STAIN-LESS STEEL 304 | NON-MAG-NETIC PAN | NON-MAG-NETIC KETTLE | COPPER PAN |
|---|---|---|---|---|---|---|---|---|---|---|
| INDUCTANCE ($\mu$H) | 72.78 | 74.48 | 95.31 | 64.3 | 77.92 | 56.34 | 51.11 | 49.84 | 61.57 | 46.16 |
| RESISTANCE ($\Omega$) | 3.08 | 2.60 | 2.37 | 2.87 | 3.80 | 2.44 | 2.18 | 1.80 | 2.28 | 0.29 |
| f0(KHz) | 25 | 24.9 | 22.0 | 26.8 | 24.3 | 28.6 | 30.0 | 30.4 | 27.3 | 31.6 |

| FIG.18 | |
|---|---|
| FIG.18a | FIG.18b |

INDUCTION HEATING COOKER WITH PHASE DIFFERENCE CONTROL

BACKGROUND OF THE INVENTION

1. Field of the Invention

The present invention relates to an induction heating cooker that employs an inverter circuit over inductively heating an object, and particularly to an induction heating cooker of large input power that causes no noise from its power source, achieves excellent efficiency and is capable of continuously changing its input power for a wide range.

2. Description of the Prior Art

An induction heating cooker produces no flame, and therefore, is safe and achieves excellent heating efficiency.

FIG. 1 is a block circuit diagram showing a conventional induction heating cooker employing an inverter circuit 104 of the quasi-E class. An input setting circuit 118 sets an input value according to which a PWM oscillator 116 provides a pulse signal. According to the pulse signal, a driving circuit 114 sets an ON time TON for a transistor 112. The transistor 112 is turned on and off in response to pulse signals from the driving circuit 114 to put a heating coil 106 and a resonant capacitor 108 in a series resonant state. Accordingly, the heating coil 106 generates magnetic flux, which causes an electromagnetic induction action to generate an eddy current in an object (not shown) such as a pan. As a result, the object is heated. An advantage of the inverter circuit 104 of quasi-E class is that high-frequency electric power can be generated with a single switching element (the transistor 112).

If the input power is increased, a resonance voltage VCE is increased as shown in FIG. 2*a*. The high resonance voltage is critical to a withstand voltage of the switching element (transistor 112). To reduce the input power as shown in FIG. 2*b*, the ON time TON of the transistor 112 shall be shortened. In this case, the transistor 112 is usually turned on before the resonance voltage VCE reaches zero volts. If this happens, an excessive short-circuit current IS flows to the transistor 112 to destroy the transistor.

Supposing the cooker is 200 V in power source voltage and 2 KW in maximum input power, the resonance voltage VCE will reach 1100 V for the maximum input power. When the ON time TON of the switching element is reduced to bring the input power to 1 KW, the magnitude of the short-circuit current will be 80 A.

Supposing the cooker is 3 KW in maximum input power, the resonance voltage VCE will be 1800 V for the maximum input power. To bring the input power below 2 KW, the short-circuit current IS must be very large. To avoid this, it is necessary to repeatedly turn on and off the inverter circuit. This may, however, change the temperature of the cooker and deteriorate cooking efficiency.

If the maximum input power is 3.5 KW to shorten the cooking time, the resonance voltage VCE may reach 2000 V or over. There is no such switching element that can withstand the resonance voltage of 2000 V and achieve a high-speed switching operation. The inverter circuit of quasi-E class is, therefore, not applicable for a large power induction heating cooker.

For such a large power induction heating cooker, a bridge inverter circuit has been proposed. In this type of cooker, a voltage larger than a power source voltage is applied to its switching element so that input power of the cooker may easily be increased. In addition, the cooker can heat an object made of non-magnetic material such as aluminum and stainless steel.

To control the input power of the cooker, the bridge inverter circuit is turned on and off. Alternatively, as shown in FIG. 3, an input controlling circuit 133 may provide a control signal based on which thyristors 107*a* and 107*b* are controlled, thereby continuously controlling the input power. This technique is called phase control.

In FIG. 3, a half bridge inverter circuit 125 receives signals from an inverter driving circuit 113 to alternately turn transistors 115 and 117 on and off, thereby applying high-frequency electric power to a heating coil 119.

A conventional induction heating cooker employing the bridge inverter circuit that is turned on and off to control input power has a problem of generating a repulsive force in heating an aluminum pan. As shown in FIG. 5, heating the aluminum pan with a cooker of 2000 W in input power generates a repulsive force of 920 g. If the aluminum pan weighs, for example, about 1 Kg, the pan may move over a top plate of the cooker. This is dangerous. If the bridge inverter circuit is turned on and off to decrease the input power from 2000 W, a replusive force of 920 g is intermittently generate whenever the inverter circuit is turned on, to gradually move the aluminum pan and generate unpleasant noise.

In FIG. 3, the input power is continuously controlled, and an input current IIN from an AC power source 101 is intermittently supplied, as shown in FIGS. 4*a* and 4*b*. Due to this, the power source emits noise.

To deal with this, a large capacity reactor 103 is inserted between the AC power source 101 and the bridge circuit 105. The reactor or a thyristor, however, has a loss that lowers efficiency.

A thyristor, if employed, requires a radiating plate, which raises another problem of increasing the size of the cooker.

SUMMARY OF THE INVENTION

An object of the present invention is to provide an induction heating cooker that allows large input power, causes no noise from its electric power source, has excellent efficiency and is capable of continuously changing its input power over a wide range.

According to a first aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; and frequency controlling means for controlling, according to a signal from the phase comparing means, an oscillation frequency of the inverter circuit to establish the phase difference set by the phase difference setting means.

According to a second aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; frequency controlling means for controlling, according to a signal from the phase comparing means, an oscillation frequency of the inverter circuit to establish the phase difference set by the phase difference setting means; input setting means for setting a heating force for heating the object; and first phase-difference changing means for changing the set phase difference in response to a value set by the input setting means.

According to a third aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; frequency controlling means for controlling, according to a signal from the phase comparing means, an oscillation frequency of the inverter circuit to establish the phase difference set by the phase difference setting means; material information detecting means for detecting information relating to material of the object; and second phase-difference changing means for changing the set phase difference according to the material information detected by the material information detecting means.

According to a fourth aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; frequency controlling means for controlling, according to a signal from the phase comparing means, an oscillation frequency of the inverter circuit to establish the phase difference set by the phase difference setting means; and phase difference restricting means for restricting the set phase difference so that the heating coil and resonance capacitor may form an inductive resonance circuit.

According to a fifth aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; frequency controlling means for controlling, according to a signal from the phase comparing means, an oscillation frequency of the inverter circuit to establish the phase difference set by the phase difference setting means; and frequency restricting means for restricting the frequency controlled by the frequency controlling means not to be decreased lower than a predetermined value.

According to a sixth aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; frequency controlling means for controlling, according to a signal from the phase comparing means, an oscillation frequency of the inverter circuit to establish the phase difference set by the phase difference setting means; and current restricting means for restricting the current flowing to the resonance capacitor not to be decreased lower than a predetermined value.

According to a seventh aspect of the present invention, there is provided an induction heating cooker comprising an inverter circuit involving a heating coil and a resonance capacitor that resonates with the heating coil to generate high-frequency electric power for inductively heating an object to be heated; phase comparing means for comparing the phase of a first signal that correlates to the phase of an output voltage of the inverter circuit with the phase of a second signal that correlates to the phase of a current flowing to the resonance capacitor; phase difference setting means for setting a phase difference of the first and second signals; and frequency controlling means for controlling, according to a signal from the phase comparing means, an oscillation frequency of the inverter circuit to establish the phase difference set by the phase difference setting means, the frequency controlling means gradually lowering the oscillation frequency of the inverter circuit from high to low at the start of operation of the frequency controlling means.

The induction heating cooker according to the first aspect of the present invention has the phase difference setting means for setting the phase difference between the phase of the first signal correlating to the phase of the output voltage of the inverter circuit and the second signal correlating to the phase of the current flowing to the resonance capacitor. The phases of the first and second signals are compared with each other, and the oscillation frequency of the inverter circuit is controlled to establish the set phase difference. With this arrangement, input power of the cooker can continuously be changed in a wide range, and noise from a power source of the cooker is eliminated.

The induction heating cooker according to the second aspect of the present invention has the input setting means in addition to the features of the first aspect. The phase difference set by the phase difference setting means is changed in response to an input set by the input setting means. With this arrangement, the same input power may be secured by the same setting for heated objects of different materials and different shapes.

The induction heating cooker according to the third aspect of the present invention has the material information detecting means in addition to the features of the first aspect. The detecting means detects information relating to material of an object to be heated, and the phase difference is changed according to the detected information. With this arrangement, input power can be stabilized irrespective of the material of the object.

The induction heating cooker according to the fourth aspect of the present invention has all the features of the cooker of the first aspect, and in addition, restricts the phase difference of the first and second signals to make the heating coil and resonance capacitor from an inductive resonance circuit. With this arrangement, an oscillation frequency of the inverter is set larger than a resonance frequency of the resonance circuit, thereby preventing a switching element from sustaining an excessive short-circuit current.

The induction heating cooker according to the fifth aspect of the present invention has all the features of the cooker of the first aspect, and in addition, restricts a frequency controlled by the frequency controlling means not to be lowered below a predetermined value. With this arrangement, the inverter circuit can be securely driven even when the oscillating operation of the frequency controlling means is unstable.

The induction heating cooker according to the sixth aspect of the present invention has all the features of the cooker of the first aspect, and in addition, restricts a current flowing to the resonance capacitor not to be lowered below a predetermined value. With this arrangement, even an object having low impedance can be heated with the inverter circuit being securely driven and with no excessive current that may destroy the switching element.

The induction heating cooker according to the sixth aspect of the present invention has all the features of the cooker of the first aspect, and in addition, gradually reduces the oscillation frequency of the inverter circuit from high to low at the start of operation of the frequency controlling means. With this arrangement, the inverter circuit can be securely driven even at the start of the cooker operation wherein the circuit operation is unstable.

These and other objects, features and advantages of the present invention will be more apparent from the following detailed description of preferred embodiments in conjunction with the accompanying drawings.

BRIEF DESCRIPTION OF THE DRAWINGS

FIGS. 11*a* and 11*b* are tables of heated objects made of different materials and their resonance frequencies;

FIGS. 18, 18*a* and 18*b* is a circuit diagram showing the details of FIG. 6;

DETAILED DESCRIPTION OF THE EMBODIMENTS

Figure 7:
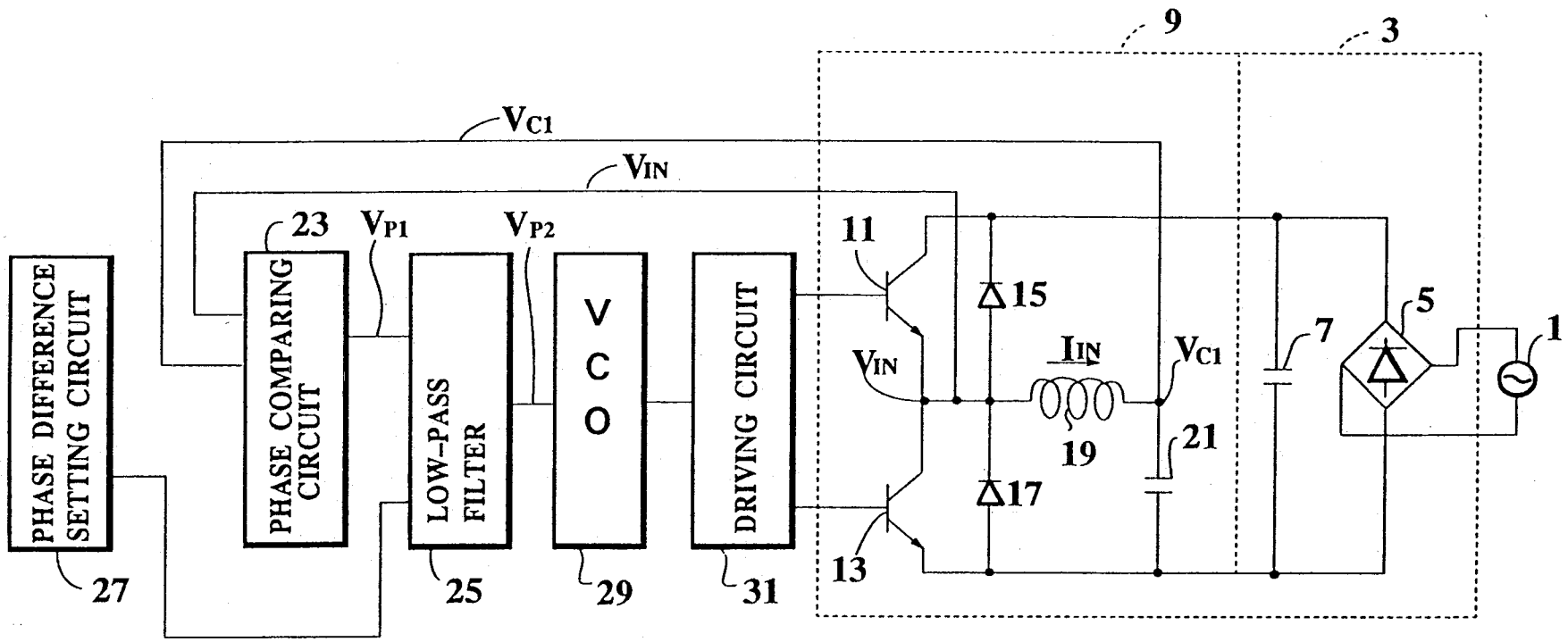
FIG. 7 is a block circuit diagram showing an induction heating cooker, according to another embodiment of the present invention.

A basic arrangement of an induction heating cooker according to the present invention will be explained with reference to FIG. 7.

An AC power source 1 is connected to a DC power source circuit 3. The DC power source circuit 3 comprises a bridge circuit 5 for rectifying DC power, and a capacitor 7 for smoothing a pulsating rectified current.

A half-bridge inverter circuit 9 comprises two transistors 11 and 13, diodes 15 and 17 disposed between the collectors and emitters of the transistors 11 and 13, a heating coil 19, and a resonance capacitor 21 connected to the heating coil 19 in series.

A phase comparing circuit 23 receives an inverter voltage VIN as a first signal and a terminal voltage VCl of the capacitor 21 as a second signal. The phase of the second signal correlates to the phase of an inverter current IIN flowing to the capacitor 21. The phase comparing circuit 23 compares the phases of the first and second signals with each other and provides a signal representative of the phase difference of both the signals to a low-pass filter 25.

A phase difference setting circuit 27 sets the phase difference of the first and second signals.

A voltage-controlled oscillator (VCO) 29 is a frequency controlling means for controlling the oscillation frequency of the invertor circuit 9 to establish the phase difference set by the phase difference setting circuit 27. The VCO 29 changes the oscillation frequency in response to a signal voltage from the low-pass filter 25.

A driving circuit 31 alternately turns the transistors 11 and 13 on and off according to signals from the VCO 29.

The operation of the arrangement of FIG. 7 will be explained with reference to FIGS. 8*a* to 8*d*.

When the transistors 11 and 13 are alternately turned on and off according to the signals from the driving circuit 31, the heating coil 19 and capacitor 21 are put under a series resonant state, and the heating coil 19 generates high-frequency electric power with which an object such as a pan is heated.

If the oscillation frequency of the inverter circuit 9 is equal to a resonance frequency fO of the series resonance circuit composed of the heating coil 19 and resonance capacitor 21, the series resonance circuit will have only resistance load, and load impedance Z will be expressed by the following equation (1):

$$Z = RL + RC \quad (1)$$

where RL is the load resistance and RC the resistance of the heating coil 19.

The equation (1) tells that the load impedance Z has only resistance components. Under this state, a load current takes its maximum value. During a period Ta shown in FIGS. 8*a* and, 8*b*, effective electric power is supplied to the series resonant circuit. At this time electrical energy output is maximum.

Figure 8A:
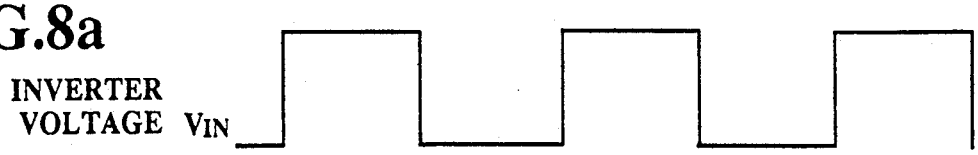
FIGS. 8*a* to 8*d* are waveforms of signals generated in the cooker of FIG. 7.
Figure 8B:
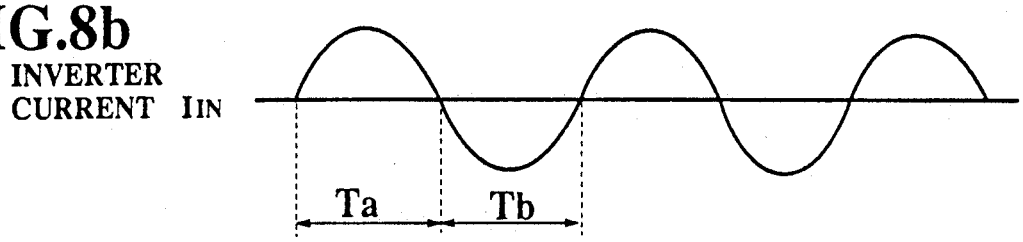
Figure 8C:
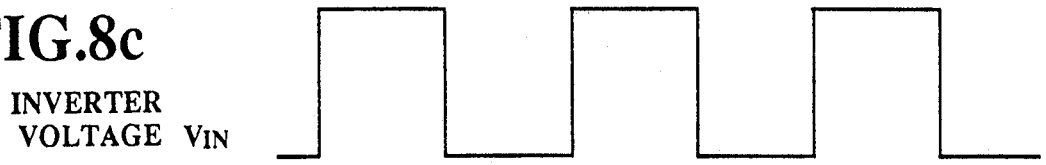
Figure 8D:
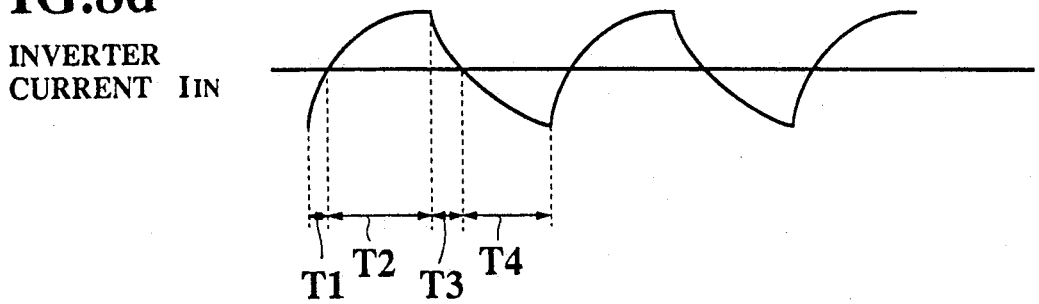

To control input power, the phase difference setting circuit 27 sets the phase difference of the first and second signals VIN and VCl greater than 90° according to an external instruction signal SIN. By setting the phase difference greater than 90°, an inductive load state is established, and the phase of the inverter current IIN delays behind that of the inverter voltage VIN as shown in FIGS. 8*c* and 8*d*. At this time, the load impedance Z is expressed by the following equation (2):

$$Z = \sqrt{(RL + RC)^2 + \left(\omega L - \frac{1}{\omega C}\right)^2} \quad (2)$$

As shown in FIG. 8*d*, electric power is supplied to the series resonance circuit during a short period T2. In this way, the set phase difference greater than 90° increases the load impedance Z and reduces a current flowing to the inverter circuit 9 to make the input power continuously low.

Figure 9:
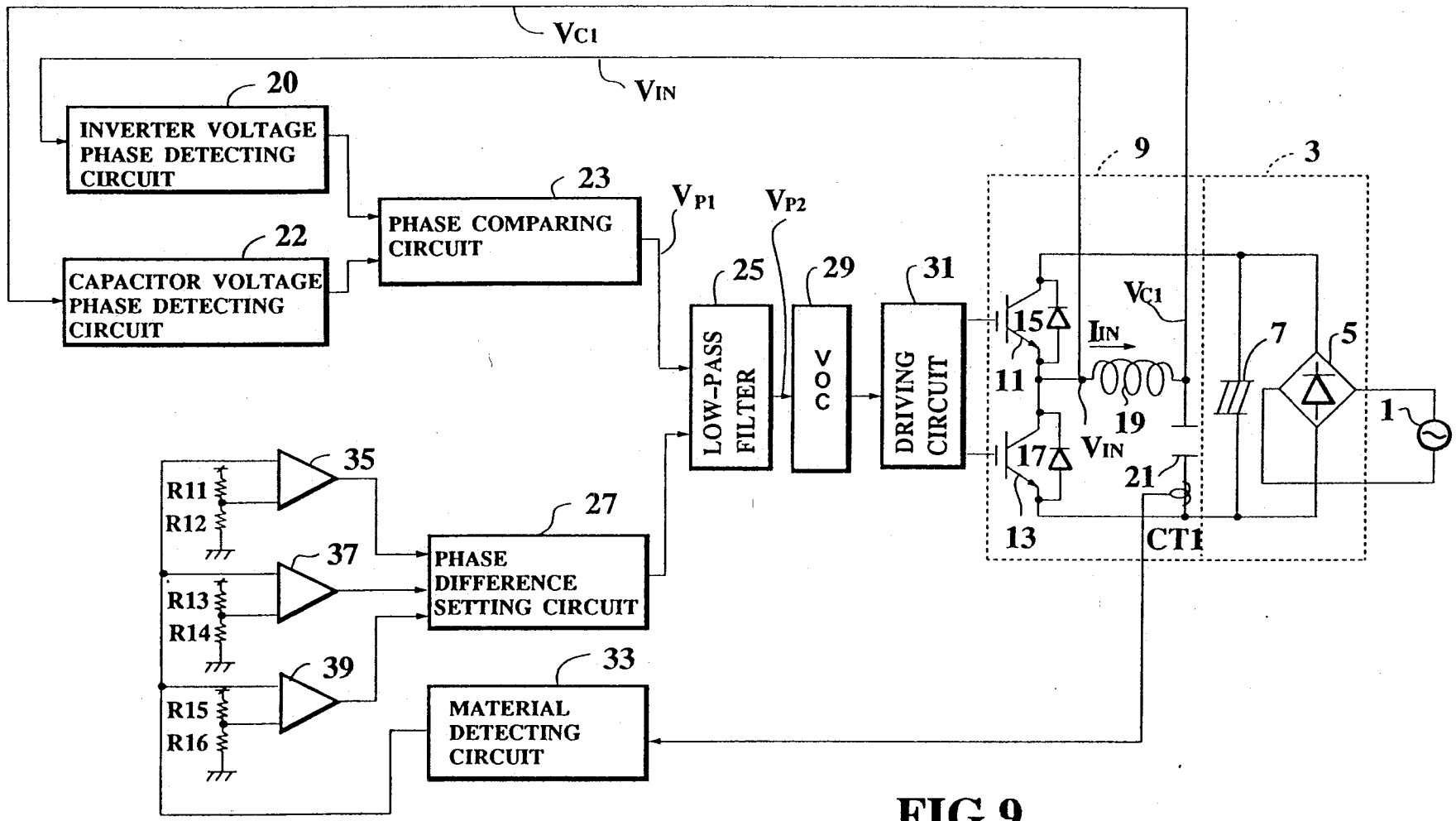
FIG. 9 is a block circuit diagram showing an induction heating cooker according to still another embodiment of the present invention.

FIG. 9 shows an induction heating cooker according to an another embodiment of the present invention.

A material detecting circuit 33 detects information about the material of an object (pot) to be heated by the cooker. According to the material information, a phase difference set by a phase difference setting circuit 27 is changed, thereby stabilizing input power irrespective of the material of the object.

Figure 10A:
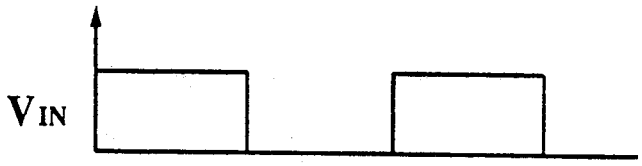
FIGS. 10*a* to 10*e* are explanatory views showing the operations of the embodiment of FIG. 9.
Figure 10B:
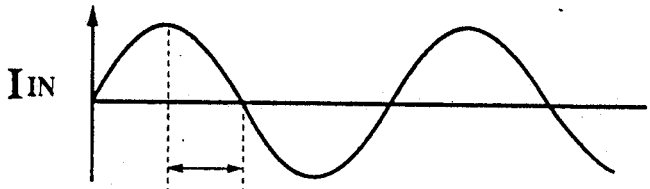
Figure 10C:
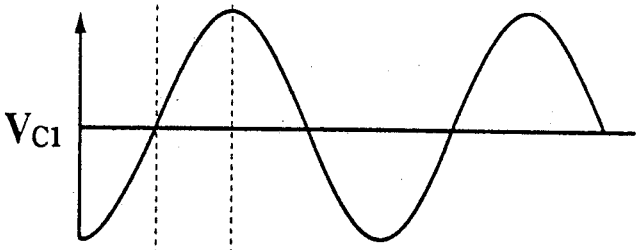

An inverter voltage phase detecting circuit 20 detects an inverter voltage VIN (FIG. 10*a*) and provides the same to a phase comparing circuit 23. A capacitor voltage phase detecting circuit 22 detects a terminal voltage VCl (FIG. 10*c*) of a resonance capacitor 21 and provides the same to the phase comparing circuit 23. An inverter current IIN (FIG. 10*b*) is in synchronization with the inverter voltage VIN, and the phase of the voltage VCl is delayed by 90° behind that of the inverter current IIN.

Figure 10D:
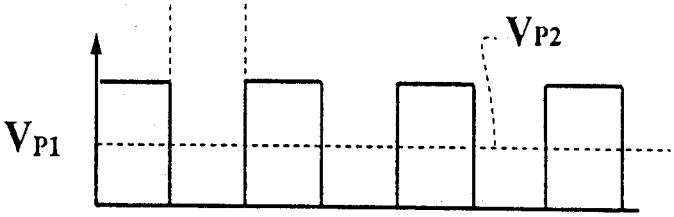

The phase comparing circuit 23 comprises an exclusive OR circuit, etc. The phase comparing circuit 23 receives the inverter voltage VIN and the voltage VCl, and provides a signal VPl (FIG. 10*d*) to a low-pass filter 25. The low-pass filter 25 receives a signal from the phase difference setting circuit 27 as well as the signal VPl and provides a signal VP2 indicated with a dotted line in FIG. 10*d* to a voltage-controlled oscillator (VCO) 29.

Figure 10E:
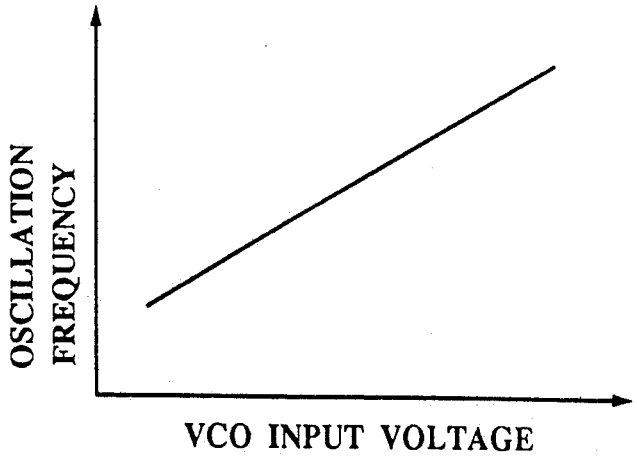

The signal VP2 from the low-pass filter 25 changes in response to a duty ratio of the signal VPl. When a series resonance circuit, formed by a heating coil 19 and a resonance capacitor 21 is inductive, the phase of the inverter current IIN is delayed behind the phase of the inverter voltage VIN to lower the signal VP2. An oscillation frequency of the VCO 29 changes in response to its input voltage, i.e., the signal VP2 as shown in FIG. 10*e*. A driving circuit 31 drives an inverter circuit 9 according to a signal from the VCO 29.

The inverter voltage phase detecting circuit 20, capacitor voltage phase detecting circuit 22, phase comparing circuit 23, low-pass filter 25, VCO 29 and driving circuit 31 form a phase-locked loop (PLL). The PLL control can secure a predetermined heating state for various materials to be heated which may change a resonance frequency of the series resonance circuit composed of the heating coil 19 and capacitor 21.

FIGS. 11*a* and 11*b* show various materials to be heated and corresponding resonance frequencies fO. In FIG. 11*a*, the heating coil 19 has 21.5 turns (T) and the capacitor 21 is of 1 μF, while in FIG. 11*b* the heating coil 19 has 30 turns and the capacitor 21 is of 0.55 μF.

Figure 12:
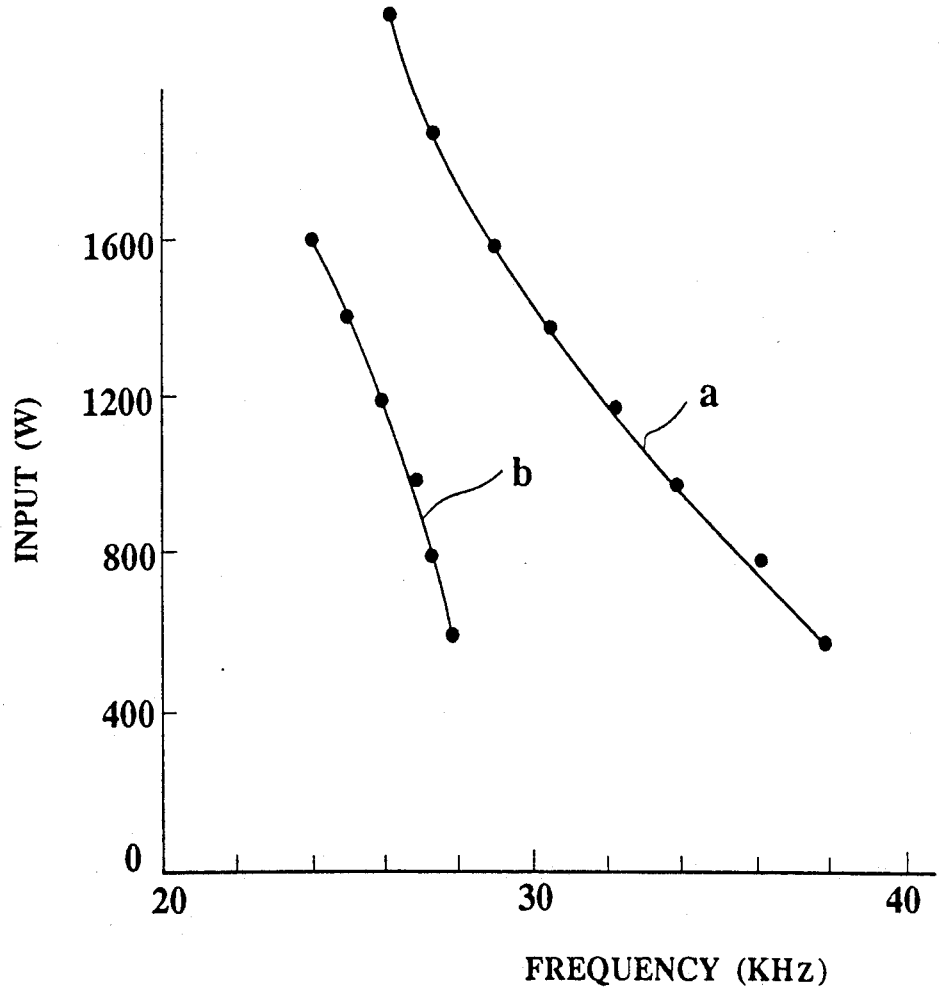
FIG. 12 is a characteristic diagram showing relation of an oscillation frequency to input power.

Each material has specific input impedance. When a pan made of non-magnetic stainless steel is heated under a resonance state, i.e., with the inverter voltage VIN and voltage VCl having a phase difference greater than 90°, excessive input power may be applied to the inverter circuit 9, as indicated by curve "a" in FIG. 12. This may cause trouble in inverter circuit 9. A curve "b" of FIG. 12 is for heating a pan made of iron and indicates relation of an oscillation frequency to input power of the inverter circuit 9.

To avoid such trouble, the embodiment of FIG. 9 controls input power according to the material of an object to be heated.

A current transformer CT1 is disposed in a passage of a current that flows to the capacitor 21 of the inverter circuit 9. The current transformer CT1 provides a signal correlating to the inverter current IIN. According to the signal, the material detecting circuit 33 provides a signal voltage, which may change in response to the material, i.e., impedance of the object.

A comparing circuit 35 compares a reference value defined by resistors R11 and R12 with the signal voltage from the material detecting circuit 33, and when judged that the material of the object is, for example, iron or magnetic stainless steel, provides an output signal to the phase difference setting circuit 27.

A comparing circuit 37 compares a reference value defined by resistors R13 and R14 with the signal voltage from the material detecting circuit 33, and when judged that the material of the object is, for example, non-magnetic stainless steel, provides an output signal to the phase difference setting circuit 27.

A comparing circuit 39 compares a reference value defined by resistors R15 and R16 with the signal voltage from the material detecting circuit 33, and when judged a no-load state that no object is placed on a top plate of the cooker, provides an output signal to the phase difference setting circuit 27.

In this way, a phase difference in the phase difference setting circuit 27 is changed according to the material, so that constant input power may be secured irrespective of the material to be heated. When a pot made of non-magnetic stainless steel having low impedance is placed on the top plate of the cooker, the phase difference is increased to oscillate the inverter circuit 9 at a frequency greater than the resonance frequency fO of the series resonance circuit, thereby controlling the input power.

The phase difference setting circuit 27 may follow an externally given instruction signal SIN to set the phase difference of the first and second signals VIN and VCl greater than 90° in controlling the input power.

Figure 1:
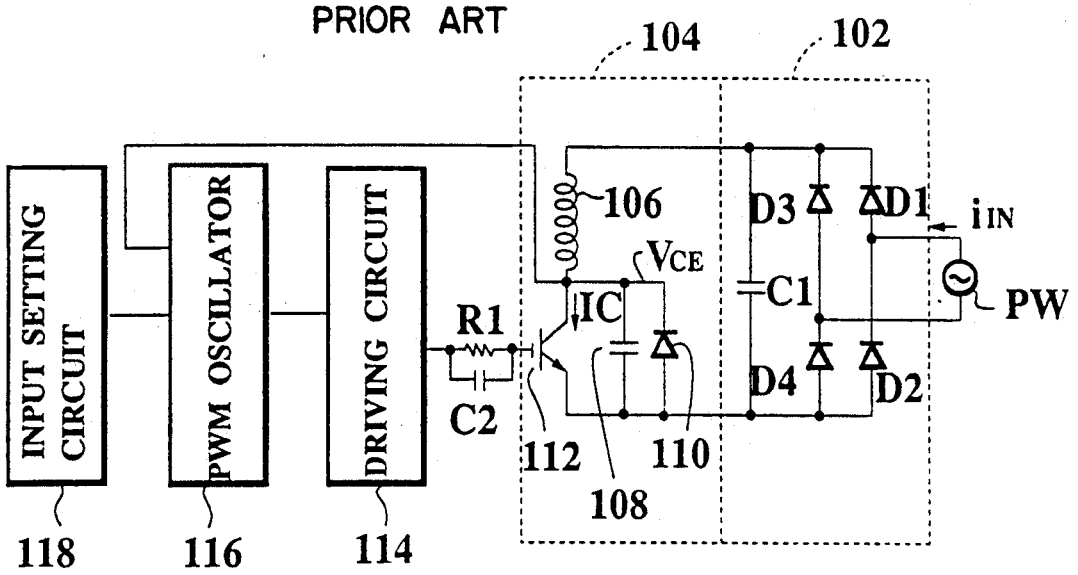
FIG.1 PRIOR ART
FIG. 1 is a block circuit diagram showing an induction heating cooker according to a prior art.
Figure 2A:
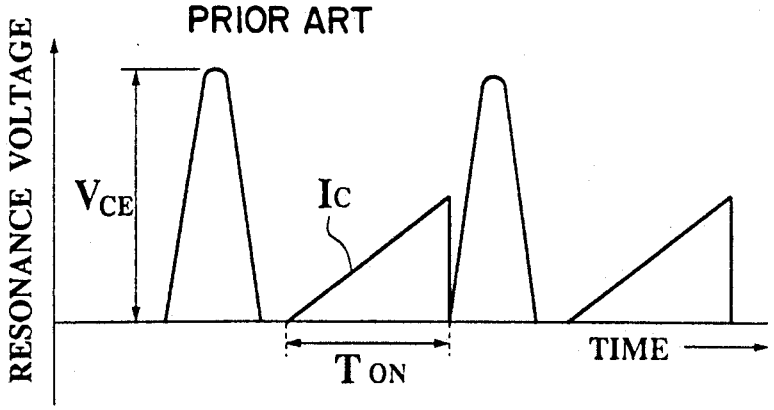
FIG.2a PRIOR ART
FIGS. 2*a* and 2*b* are waveforms of signals generated in the cooker of FIG. 1.
Figure 2B:
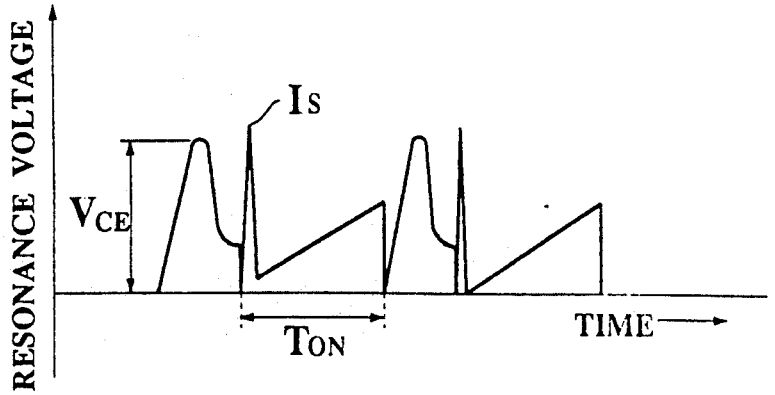
FIG.2b PRIOR ART
Figure 3:
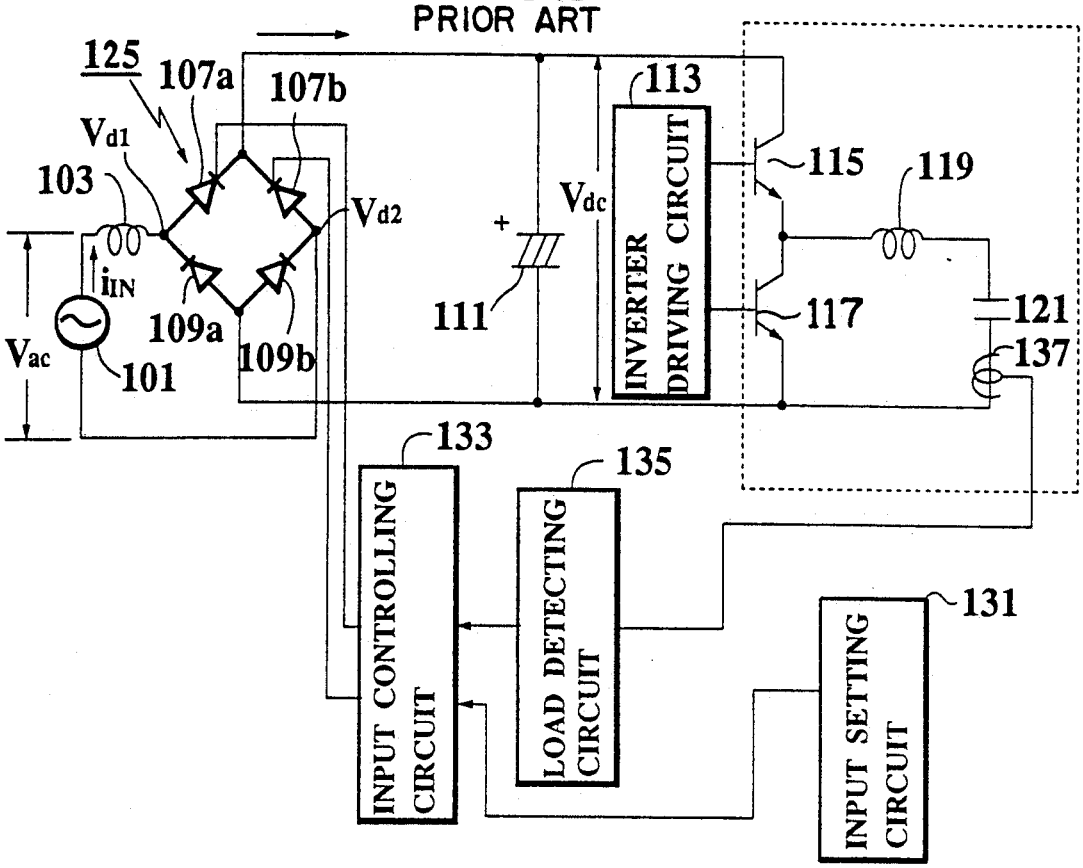
FIG.3 PRIOR ART
FIG. 3 is a block circuit diagram showing an induction heating cooker according to another prior art device.
Figure 4A:
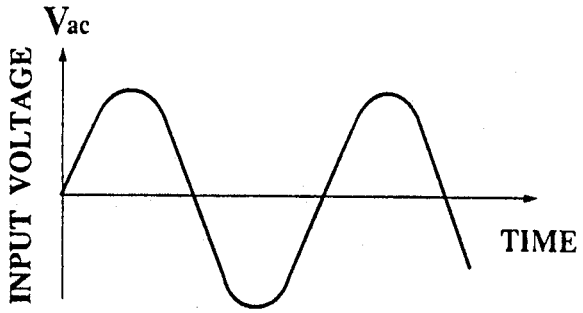
FIG.4a PRIOR ART
FIGS. 4*a* and 4*b* are waveforms of signals generated in the cooker of FIG. 3.
Figure 4B:
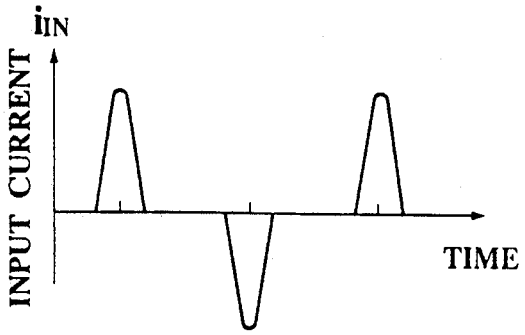
FIG.4b PRIOR ART
Figure 5:
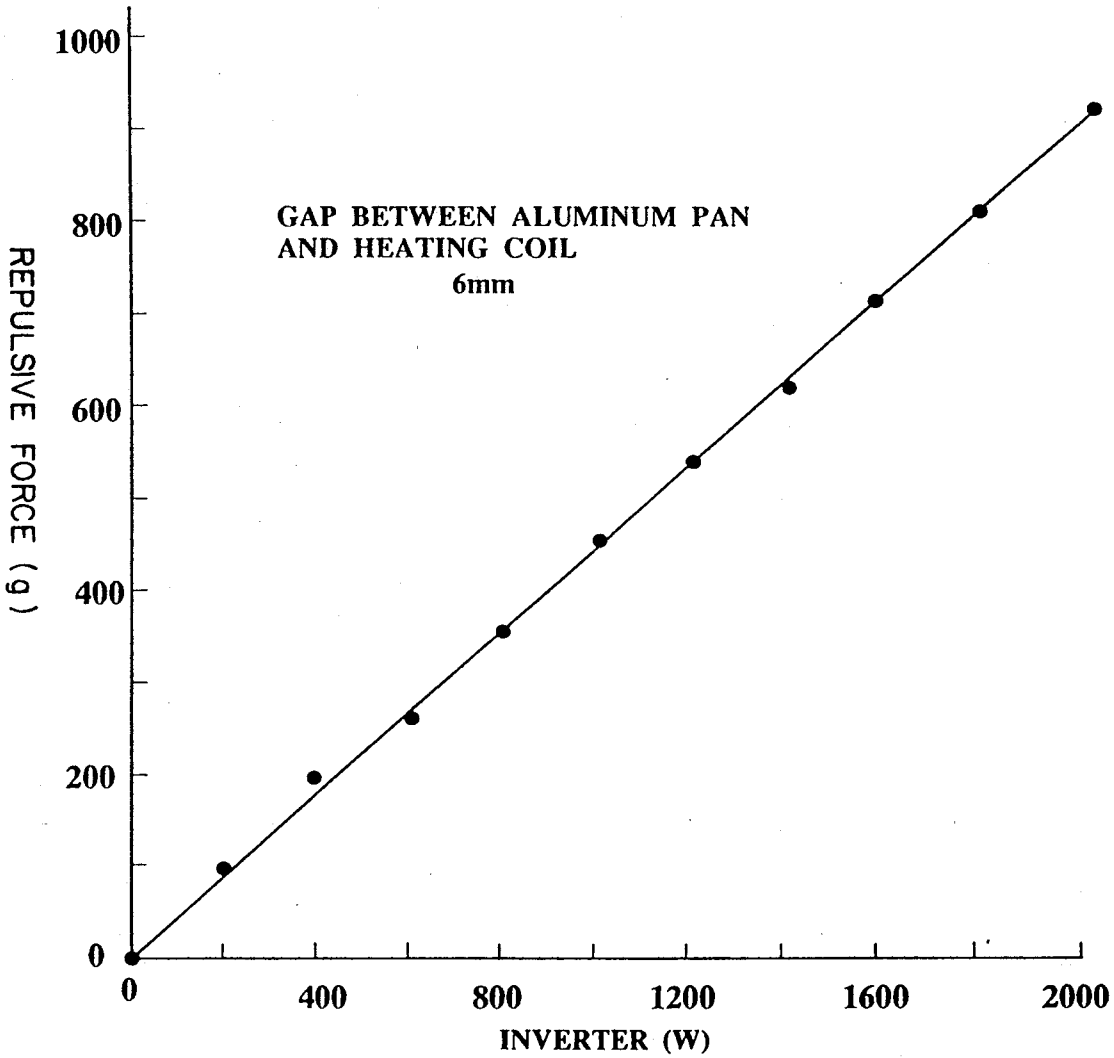
FIG.5 PRIOR ART
FIG. 5 is a characteristic diagram showing the relation of input power to a repulsive force in an inverter circuit.
Figure 6:
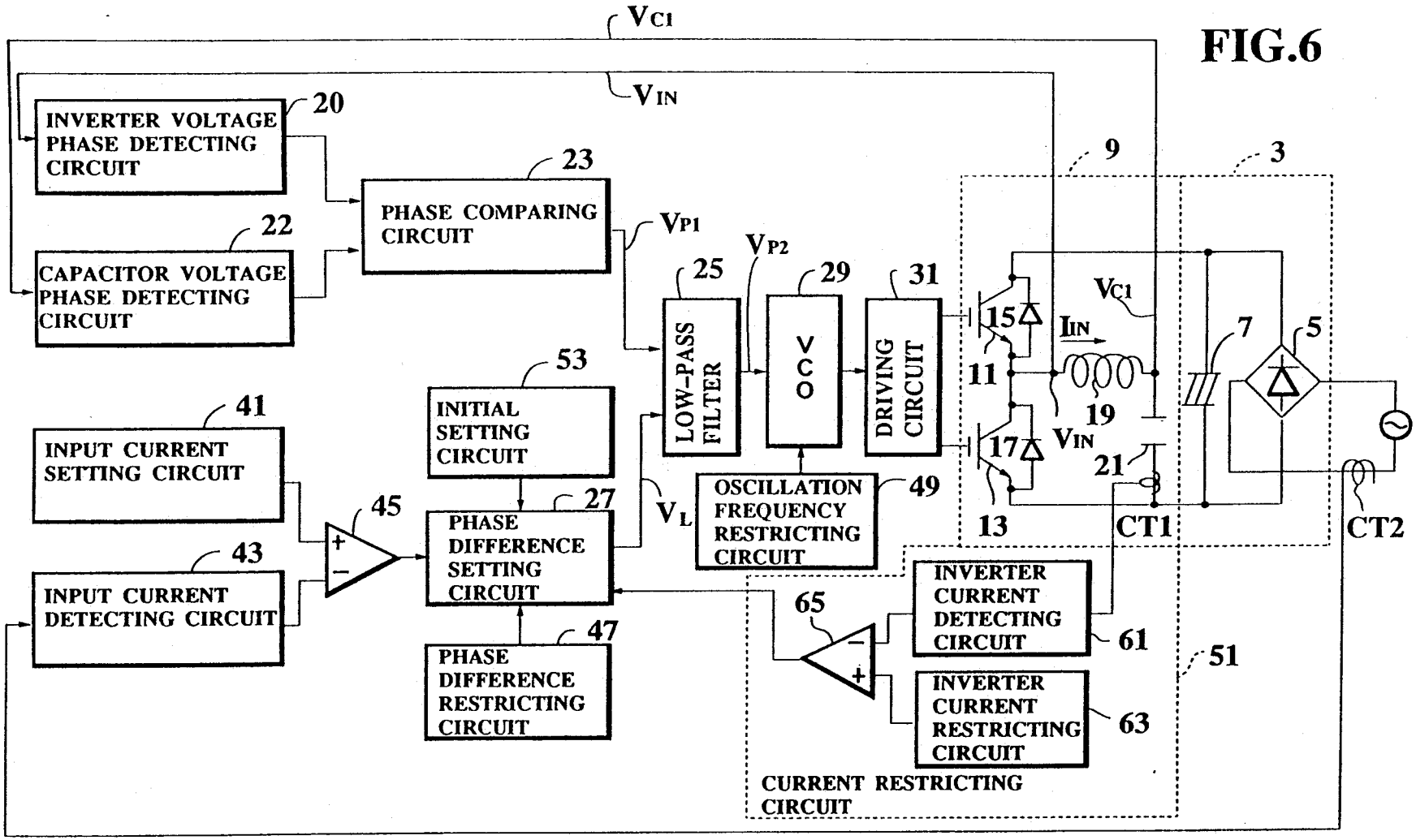
FIG. 6 is a block circuit diagram showing an induction heating cooker according to an embodiment of the present invention.

FIG. 6 shows an induction heating cooker according to another embodiment of the present invention.

The cooker comprises an input current setting circuit 41; an input current detecting circuit 43; a comparing circuit 45 for comparing output signals of the circuits 41 and 43 with each other; a phase difference restricting circuit 47 for restricting a phase difference to put a series resonance circuit, formed by a heating coil 19 and a resonance capacitor 21 in an inductive state; and oscillation frequency restricting circuit 49 for restricting an oscillation frequency not to be lowered below a predetermined value; a current restricting circuit 51 for restricting a current flowing to the capacitor 21 not to be lowered below a predetermined value; and an initial setting circuit 53 for gradually lowering the oscillation frequency of an inverter circuit 9 from high to low at the start of operation of the cooker.

The input current detecting circuit 43 detects an input current from an AC power source 1 according to a signal from a current transformer CT2. The comparing circuit 45 compares a value set by the input current setting circuit 41 with the value detected by the input current detecting circuit 43, and provides a resultant signal to a phase difference setting circuit 27.

The phase difference setting circuit 27 changes a phase difference according to the signal from the comparing circuit 45, thereby securing constant input power irrespective of the material and shape of an object to be heated.

If the oscillation frequency of the inverter circuit 9 is decreased to put the series resonance circuit in a capacitive state, a transistor 11 or 13 may be turned on to cause an excessive -circuit current to flow during an inverse recovering period for diodes 15 or 17. The inverse recovering period is a shifting period from a period T22 to a period T23 or from a period T24 to a period T21 (T25), during which carriers remaining in the diode 15 or 17 disappear.

Figure 13A:
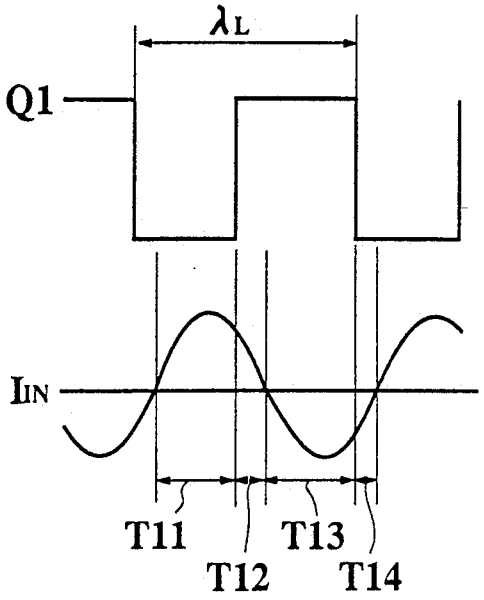
FIGS. 13*a* and 13*b* are views showing an inductive state of an oscillation circuit.
Figure 13B:
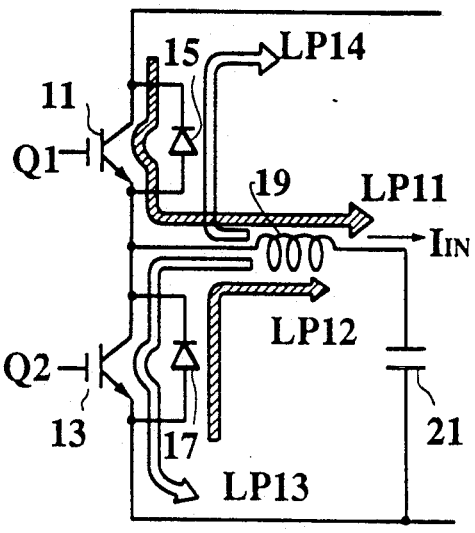
Figure 14A:
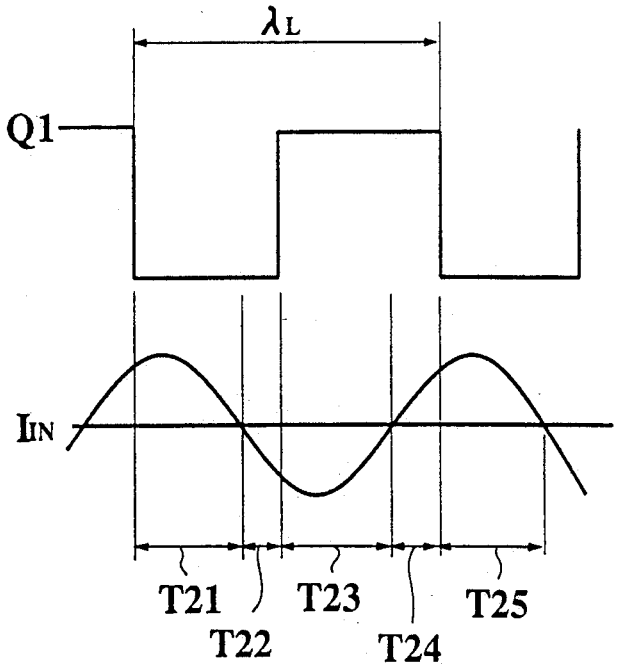
FIGS. 14*a* and 14*b* are views showing a capacitive state of the oscillation circuit.
Figure 14B:
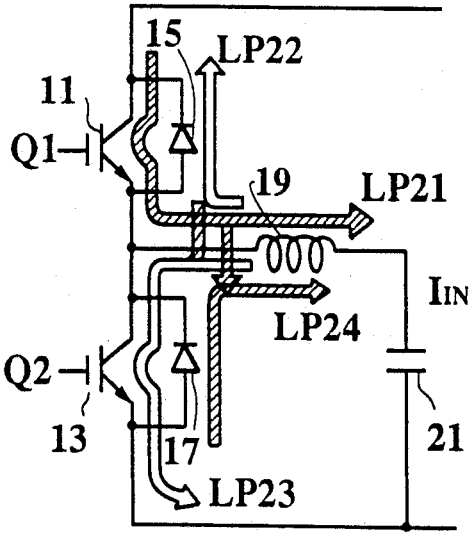

To avoid an excessive short-circuit current, the phase difference restricting circuit 47 of the present invention restricts a phase difference to exceed 90° so that the series resonance circuit may be kept inductive. As a result, the oscillation frequency of the inverter circuit 9 is greater than the resonance frequency fO of the series resonance circuit. As shown in FIG. 13, when the base of the transistor 11 receives a signal Q1, an inverter current IIN flows through a passage LP11 during a period T11. In the next period T12, the inverter current IIN flows through a passage LP12. In periods T13 and T14, the inverter current IIN flows through passages LP13 and LP14.

The current restricting circuit 51 comprises an inverter current detecting circuit 61 for detecting the inverter current IIN according to a signal from the current transformer CT1; an inverter current limit setting circuit 63 for setting a limit of the inverter current IIN; and a comparing circuit 65 for comparing output signals of the circuits 61 and 63 with each other.

In the phase difference setting circuit 27, a phase difference is changed according to an output signal from the current restricting circuit 65 to control the inverter current IIN smaller than a rated current of the transistors 11 and 13. Accordingly, an object having low impedance such as a pot made of stainless steel may be heated without causing excessive short-circuit current. Namely, without burning the transistors 11 and 13, an operation of the inverter circuit 9 is secured to heat the object.

Figure 15:
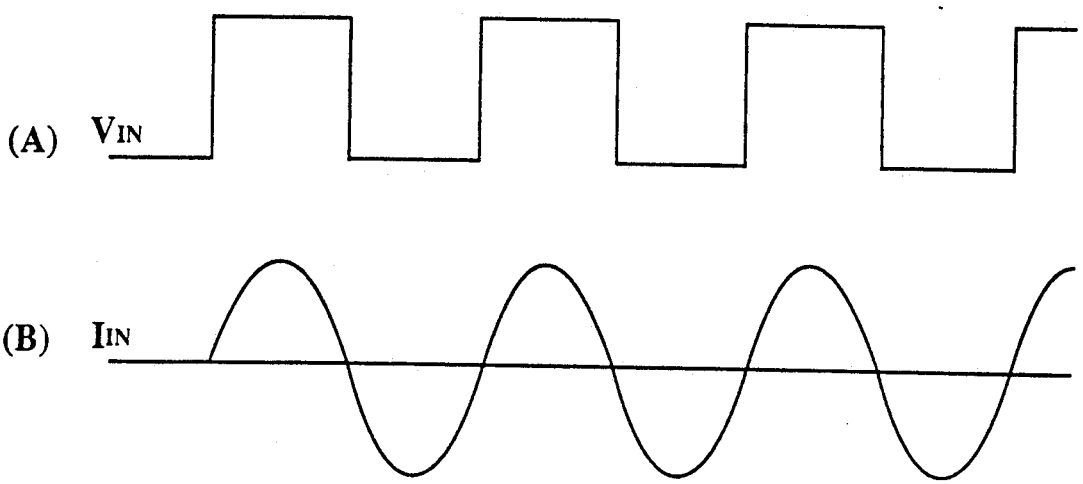
FIGS. 15 to 17 are waveforms of signals generated in the embodiment of FIG. 6.
Figure 16:
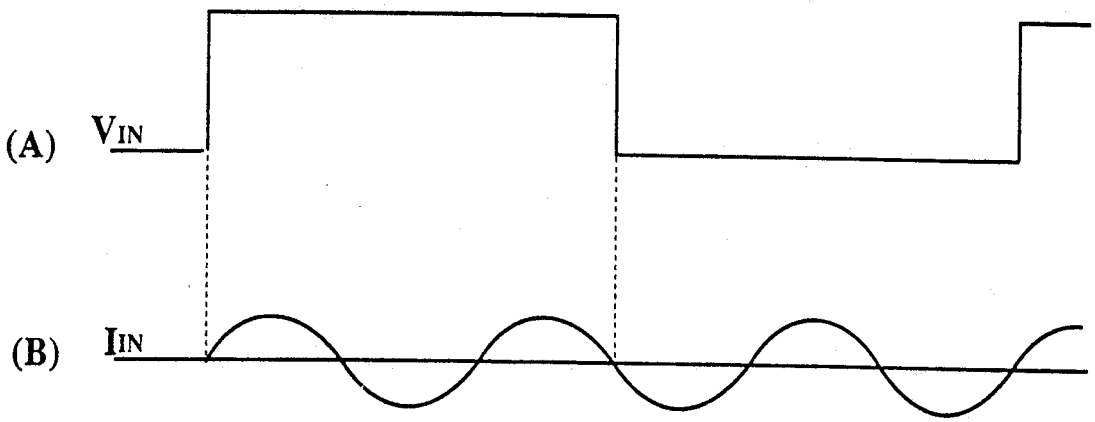

Under a normal operation, an inverter voltage VIN is in synchronization with the inverter current IIN as shown in FIG. 15. At the start of operation of a voltage-controlled oscillator (VCO) 29 or the cooker, oscillation of the VCO 29 is unstable. At this time, if an oscillation frequency becomes one third of the resonance frequency fO of the series resonance circuit as shown in FIG. 16, the PLL control mentioned before may be locked to disorder the operation of the inverter circuit 9.

To cope with starting instability, the oscillation frequency restricting circuit 49 of the present invention controls the oscillation frequency of the VCO 29, so as to be lowered below a predetermined value. The predetermined value is set to be lower than the lowest oscillation frequency of the inverter circuit 9 according to the material of an object to be heated. Accordingly, the inverter circuit 9 is securely driven even when the oscillation of the VCO 29 is unstable.

At the time when a power source is turned on, operations of the respective circuits are unstable, so that the oscillation frequency of the inverter circuit 9 must be set as high as possible to prevent an excessive current from flowing to the inverter circuit 9.

Figure 17:
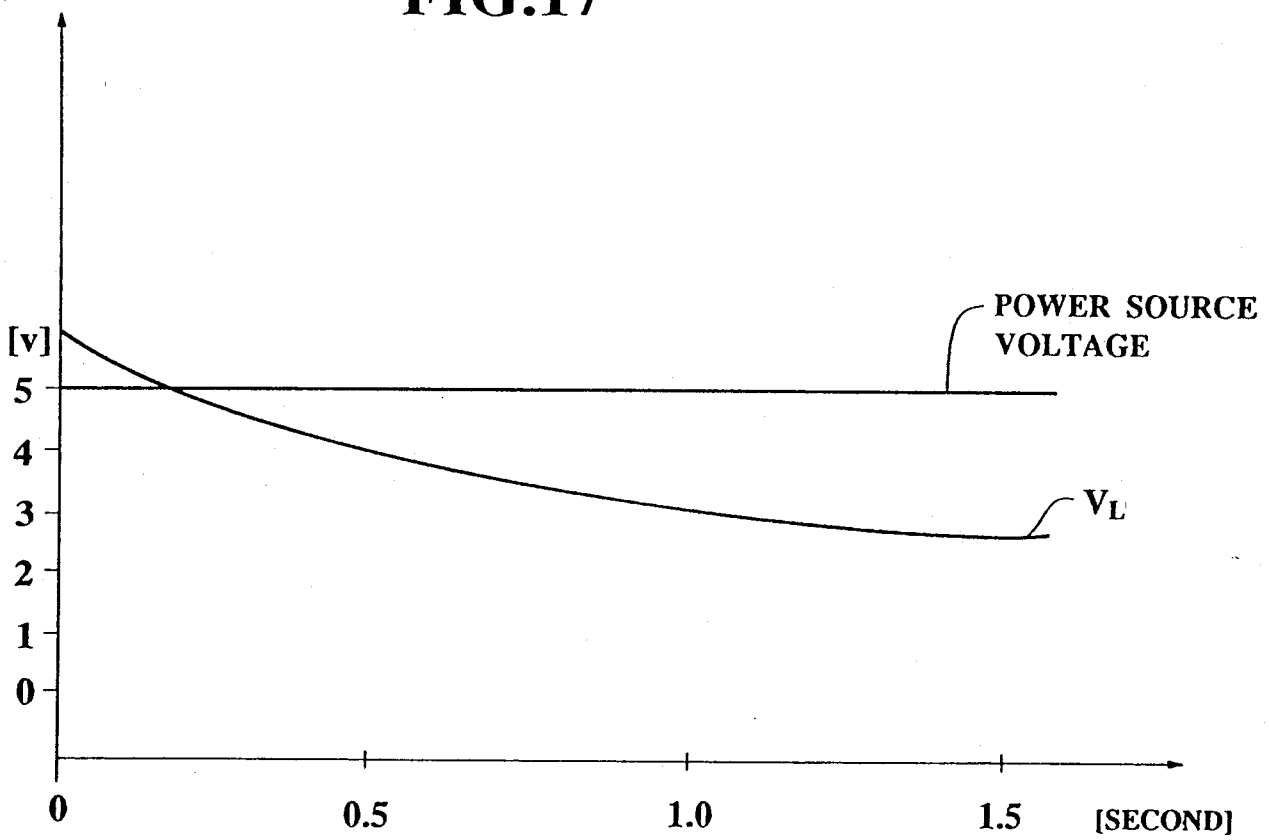

To achieve this, the initial setting circuit 53 of the present invention gradually reduces a signal voltage VL given to a low-pass filter 25 at the start of the cooker or the VCO 29 as shown in FIG. 17. As a result, the oscillation frequency of the inverter circuit 9 gradually decreases from a value higher than the resonance frequency fO, and therefore, the inverter circuit 9 is securely driven even during the initial period where circuit operations are unstable.

Figure 18A:
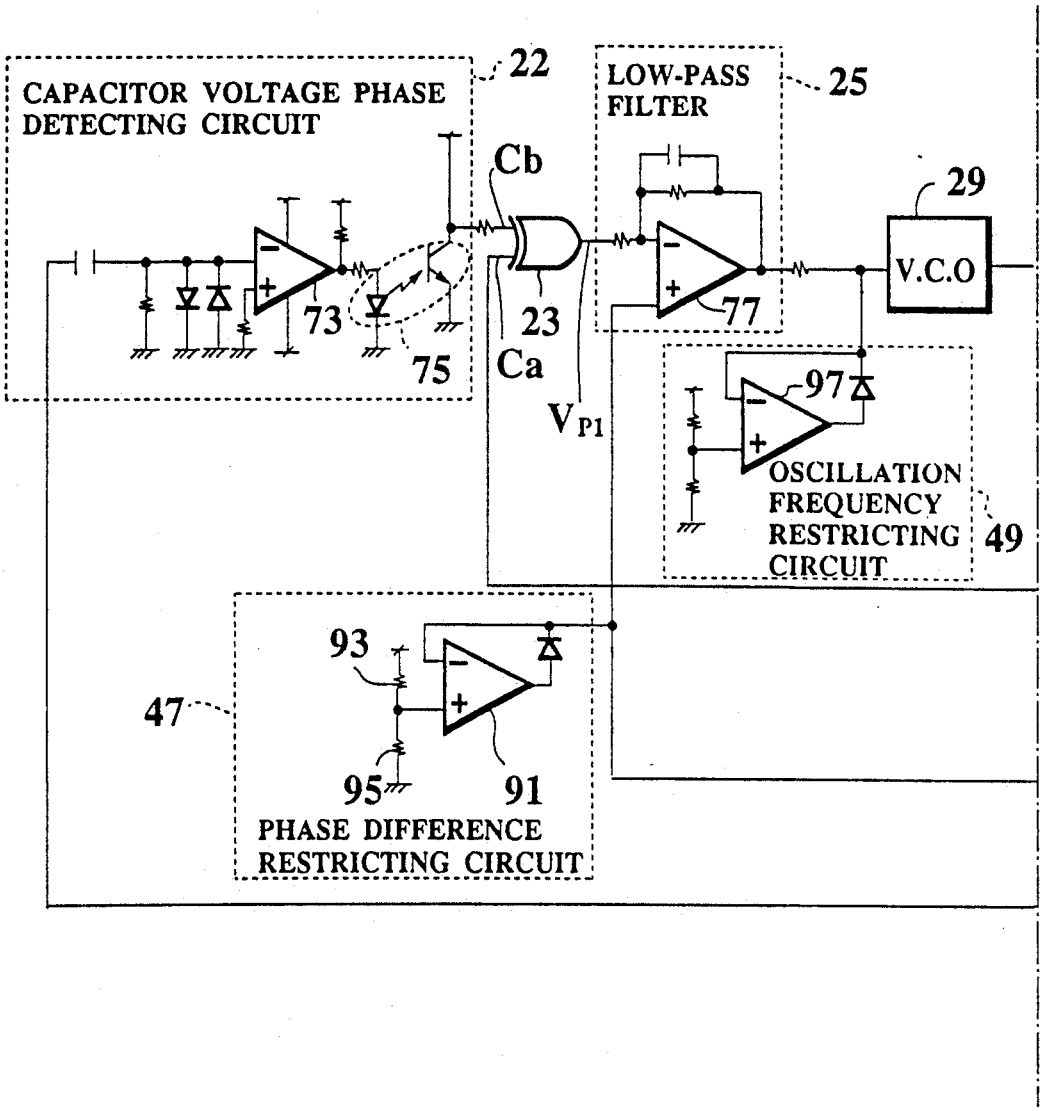

FIGS. 18*a* and *b* are circuit diagram showing the details of the above-mentioned embodiment of the present invention.

The voltage-controlled oscillator (VCO) 29 changes its oscillation frequency in response to its input voltage, and if the input voltage is 1 V, provides a rectangular pulse of 40 KHz. If the input voltage is 5 V, it provides a rectangular pulse of 170 KHz.

A dead time generating circuit 30 divides the frequency of the rectangular pulse of the VCO 29. The dead time generating circuit 30 produces a dead time not to simultaneously turn on the two transistors 11 and 13. The dead time is so set that a driving current is not supplied to one transistor until the other transistor is completely turned off after a driving current for the other transistor is stopped.

An upper arm driving circuit 31A for driving the transistor 11, and a lower arm driving circuit 31B for driving the transistor 13, constitute a driving circuit 31. Drive signals provided for the upper and lower arm driving circuits 31A and 31B have different operational potential levels from those of the transistors 11 and 13. The drive signals, therefore, are provided from the circuits 31A and 31B to the transistors 11 and 13 through pulse transformers TRA and TRB, respectively.

In the inverter circuit 9, the capacitor 21 is connected to a capacitor 71 in series. A divided voltage of between the capacitors 21 and 71 is the second signal, whose phase correlates to the phase of a current flowing to the capacitor 21 and which is provided to a capacitor voltage phase detecting circuit 22.

The capacitor voltage phase detecting circuit 22 comprises an operational amplifier 73, a photocoupler 75, etc. The circuit 22 receives the second signal and generates a rectangular pulse, and the photocoupler 75 adjusts the potential level.

Figure 19A:
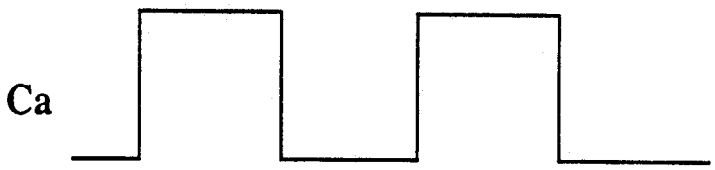
FIGS. 19*a–c* and 20*a–c* are waveforms of signals generated by respective parts of FIG. 18.
Figure 19B:
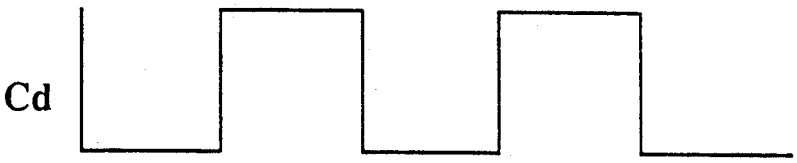
Figure 19C:
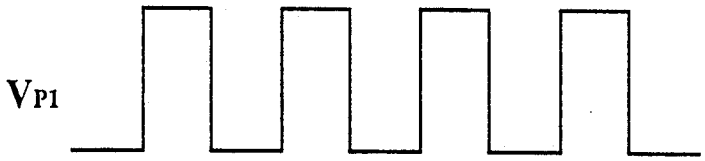
Figure 20A:
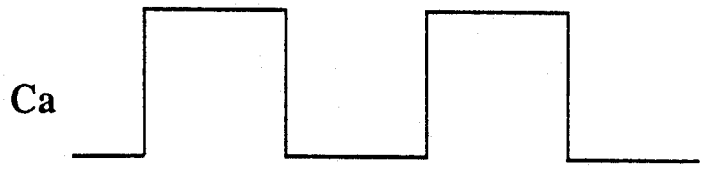
Figure 20B:
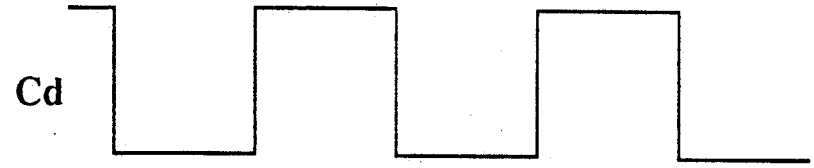
Figure 20C:
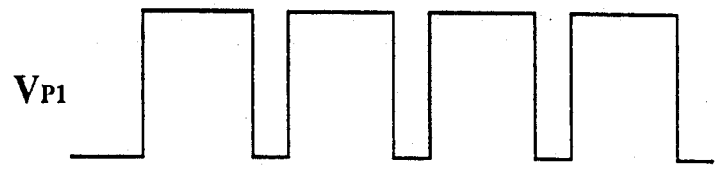

A phase comparing circuit 23 employs an exclusive OR circuit. The circuit 23 receives a first signal Ca whose phase correlates to that of an output voltage of the inverter circuit 9 from the dead time generating circuit 30, as well as a second signal Cb from the capacitor voltage phase detecting circuit 22. If the oscillation frequency of the inverter circuit 9 is equal to the resonance frequency of the series resonance circuit, the phase comparing circuit 23 provides an output signal VPl having a duty ratio of 50%. as shown in FIG. 19. If the oscillation frequency of the inverter circuit 9 is higher than the resonance frequency, the output signal VPl of the phase comparing circuit 23 has a duty ratio greater than 50% as shown in FIG. 20.

The low-pass filter 25 has an operational amplifier 77 to smooth the output signal VPl and provide a smoothed signal to the VCO 29.

A phase difference setting section 27A includes the input current setting circuit 41, comparing circuit 45 and initial setting circuit 53. The input current setting circuit 41 comprises a resistor 81 and a variable resistor 83. By adjusting the variable resistor 83, an output of the inverter circuit 9 can be changed. A signal from the variable resistor 83 is provided to a non-inverted input terminal of the comparing circuit 45. An inverted input terminal of the comparing circuit 45 receives a signal from the input current detecting circuit 43. The comparing circuit 45 compares the received signals with each other, thereby setting an output of the inverter circuit 9 to a required value.

The initial setting circuit 53 comprises resistors 85 and 87 connected in series and capacitor 89 in parallel with the resistor 85. A voltage divided by the resistors 85 and 87 is a phase controlling voltage. Immediately after the power source is turned on, the control voltage is gradually decreased from high to low due to the capacitor 89 to gradually lower the oscillation frequency of the inverter circuit 9 from high to low, thereby realizing a so-called soft start.

The phase difference restricting circuit 47 comprises an operational amplifier 91, resistors 93 and 95, etc. A divided voltage of the resistors 93 and 95 is a phase difference lower limit VLL with which a lower limit of the phase difference is controlled so as not to put the series resonance circuit into the capacitive state.

The oscillation frequency restricting circuit 49 comprises an operational amplifier 97, etc. The circuit 49 monitors an input voltage of the VCO 29 to limit the oscillation frequency of the VCO 29 not to be smaller than a predetermined value.

The current restricting circuit 51 comprises an inverter current detecting circuit 61 for detecting an inverter current, an inverter current limit setting circuit 63 for setting a limit value VUL of the inverter current, and a comparing circuit 65 for comparing the values of the circuits 61 and 63 with each other. The current restricting circuit 51 limits the inverter current not to exceed a predetermined value.

Figure 21:
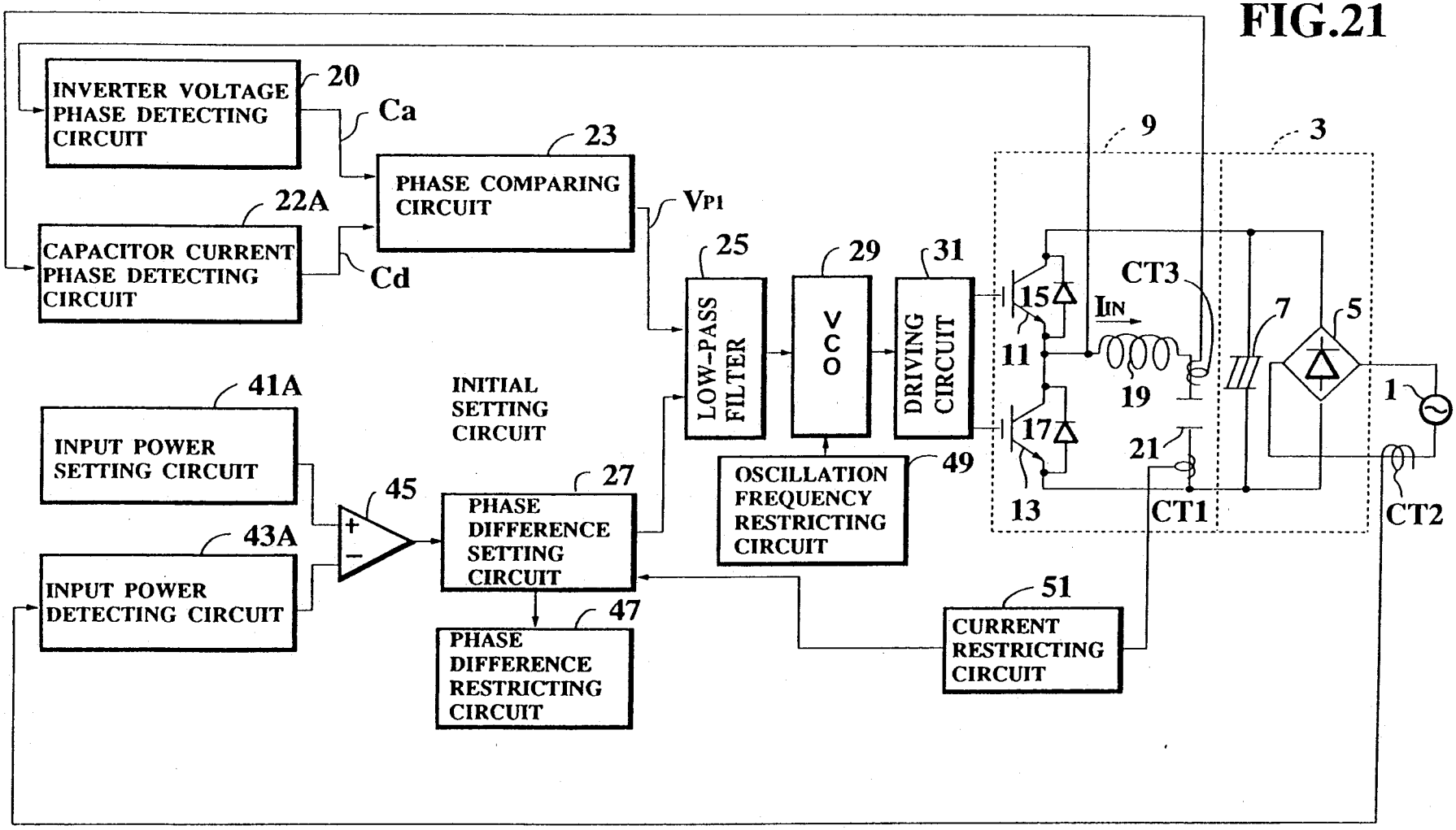
FIG. 21 is a block circuit diagram showing an induction heating cooker according to still another embodiment of the present invention.

FIG. 21 shows an induction heating cooker according to still another embodiment of the present invention.

This embodiment comprises a capacitor current phase detecting circuit 22A and a current transformer CT3. Based on a signal from the current transformer CT3, a current flowing to a resonance capacitor 21 is detected as a second signal.

Figure 18B:
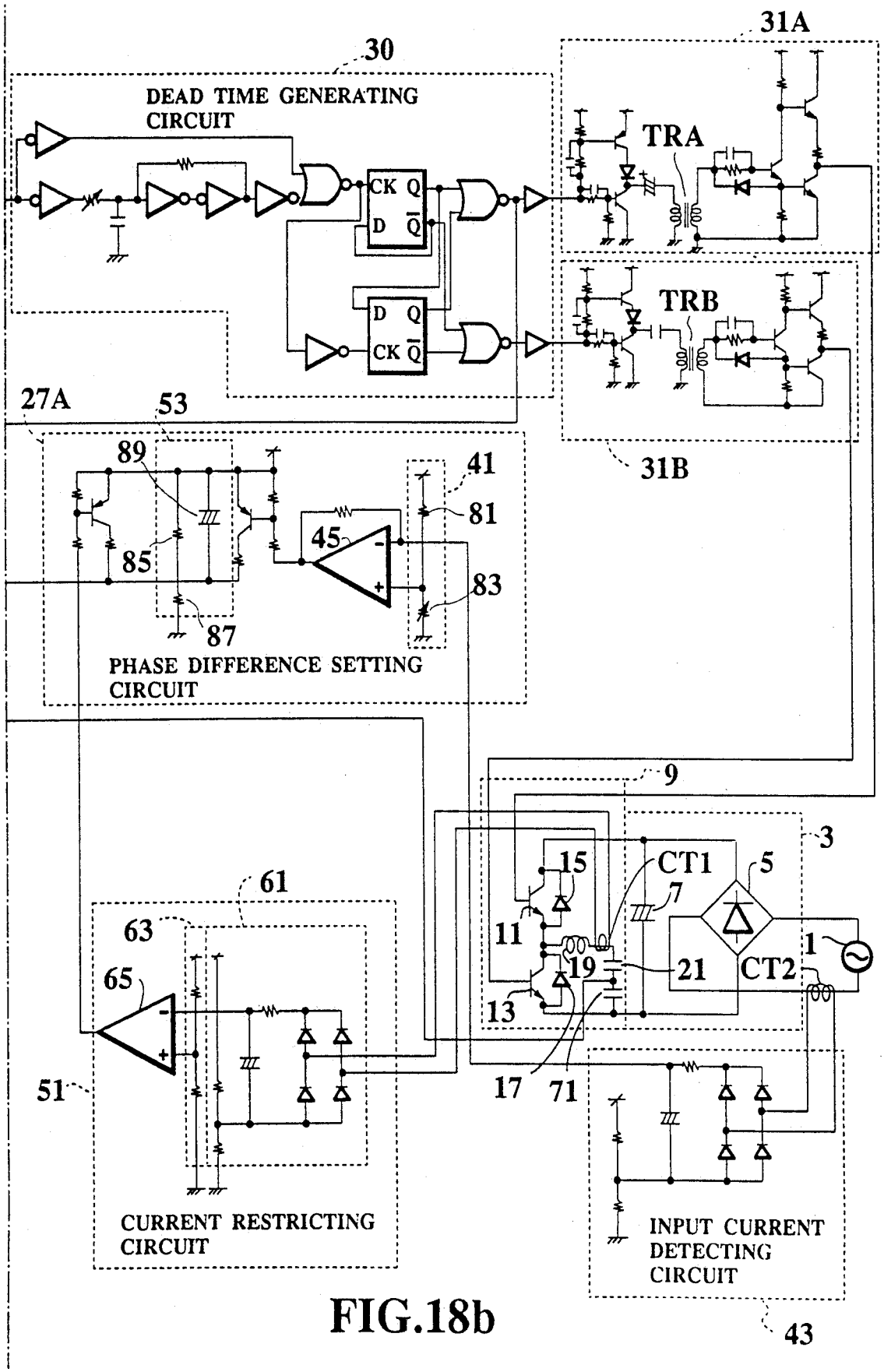

The phase of the current flowing to the capacitor 21 advances ahead the phase of a terminal voltage of the capacitor 21 by 90°. Accordingly, the phase of a signal Cd provided by the capacitor current phase detecting circuit 22A advances ahead the signal Cb shown in FIG. 18 provided by the capacitor voltage phase detecting circuit 22 of FIG. 18 by 90°.

Figure 22A:
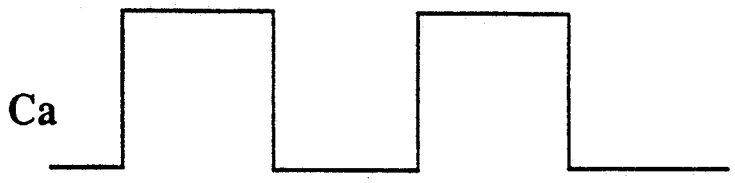
FIGS. 22*a–c* and 23*a–c* are waveforms of signals generated in the embodiment of FIG. 21.
Figure 22B:
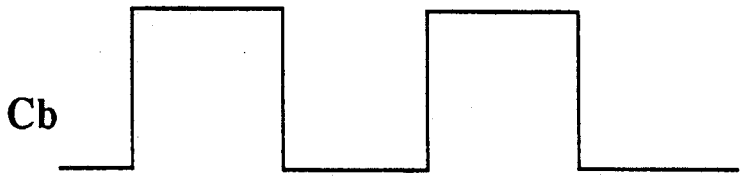
Figure 22C:
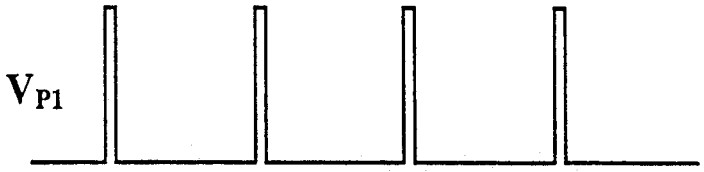
Figure 23A:
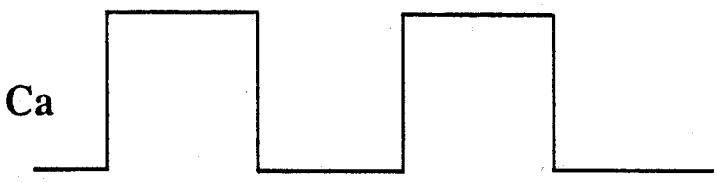
Figure 23B:
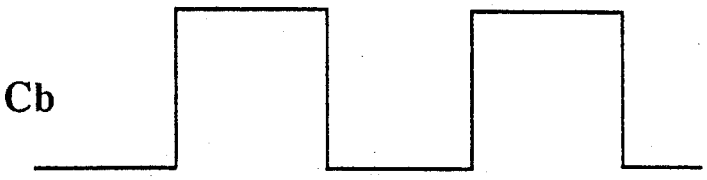
Figure 23C:
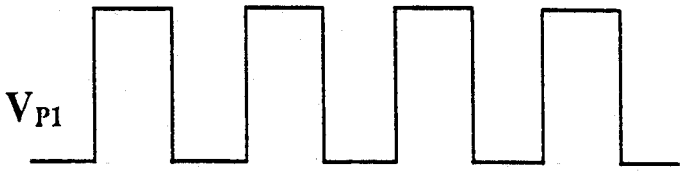

When the oscillation frequency of an inverter circuit 9 is equal to the resonance frequency of a series resonance circuit composed of a heating coil 19 and the capacitor 21, a phase comparing circuit 23 provides an output signal VPl having a duty ratio smaller than 50%, as shown in FIG. 22. When the oscillation frequency of the inverter circuit 9 is higher than the resonance frequency of the series resonance circuit, the duty ratio of the output signal is larger than that of FIG. 22, as shown in FIG. 23.

An input power setting circuit 41A sets required input power, and an input power detecting circuit 43A detects the actual input power.

Other parts of FIG. 21 are the same as those of FIG. 6, and are represented with like numerals.

The input power setting circuit 41A and input power detecting circuit 43A easily and securely set the required input power.

In summary, according to the first aspect of the present invention, the oscillation frequency of an inverter circuit is controlled to set a phase difference between the phase of a first signal correlating to the phase of an output voltage of the inverter circuit and the phase of a second signal correlating to the phase of a current flowing to a resonance capacitor. With this arrangement, input power can continuously be changed for a wide range, and noise from a power source is eliminated.

According to the second aspect of the present invention, a phase difference set by phase difference setting means is changed in response to a value set by input setting means. With this arrangement, the same input power may be secured for the same setting even for objects of different materials and different shapes.

According to the third aspect of the present invention, a material information detecting means detects information identifying the material of an object to be heated, and a phase difference is changed according to the detected information. With this arrangement, input power can be stabilized irrespective of the material of the object.

According to the fourth aspect of the present invention, a phase difference of first and second signals is restricted, so that a heating coil and a resonance capacitor may form an inductive resonance circuit. With this arrangement, the oscillation frequency of an inverter is set larger than a resonance frequency of the resonance circuit, thereby preventing a switching element from sustaining an excessive short-circuit current.

According to the fifth aspect of the present invention, a frequency controlled by frequency controlling means is restricted not to be smaller than a predetermined value. With this arrangement, an inverter circuit can be securely driven even when an oscillating operation of the frequency controlling means is unstable.

According to the sixth aspect of the present invention, a current flowing to a resonance capacitor is restricted not to be smaller than a predetermined value. With this arrangement, even an object of low impedance can be heated by securely driving an inverter circuit without burning a switching element due to an excessive current.

According to the seventh aspect of the present invention, the oscillation frequency of an inverter circuit is gradually reduced from high to low at the start of operation of the frequency controlling means. With this arrangement, the inverter circuit can securely be driven even at the start of a cooker where circuit operations are unstable.

Various modifications will become possible for those skilled in the art after receiving the teachings of the present disclosure without departing from the scope thereof.

What is claimed is:

1. An induction heating cooker, comprising:

half-bridge inverter circuit provided with a resonant circuit including a heating coil and a resonance capacitor, the resonance capacitor resonating with the heating coil to generate high-frequency electric power with which an object to be heated is inductively heated;

inverter voltage phase detecting means electrically connected to the inverter circuit for detecting the phase of the inverter voltage and providing a signal representative of such phase as a first signal;

capacitor voltage phase detecting means electrically connected to the inverter for detecting the phase of the capacitor voltage and providing a signal representative of such phase as a second signal;

phase difference comparing means electrically connected to both the inverter voltage phase detecting means and the capacitor voltage phase detecting means, to receive the first and second signals, and compare the phase of the first signal with that of the second signal, to provide a third signal representative of the phase difference between the first signal and the second signal;

phase difference setting means for setting a phase difference of the first and second signals;

low-pass filter means electrically connected to the phase difference comparing means to receive the third signal, the low-pass filter means also electrically connected to the phase difference setting means to receive external inverter controlling means through the phase difference setting means, thereby providing a fourth signal;

a voltage-controlled oscillator electrically connected to the low-pass filter means to receive the fourth signal and provide a fifth signal based on the fourth signal; and driving means electrically connected to the voltage-controlled oscillator to receive the fifth signal, the voltage-controlled oscillator also being electrically connected to the inverter circuit, such that the fifth signal is supplied from the voltage-controlled oscillator to the inverter circuit through the driving means, whereby the oscillation frequency of the inverter circuit is controlled by the inverter control means, and the phase difference between the first signal and second signal is kept at a desired value.

2. The induction heating cooker as set forth in claim 1, further comprising:

input current setting means electrically connected to the phase difference setting means to set a desired input current value for determining magnitude of the high-frequency electric power; and first phase difference changing means, electrically connected to the phase difference setting means and the input current setting means to change a phase difference value to be set by the phase difference setting means based on the desired input current value.

3. The induction heating cooker as set forth in claim 1, further comprising:

material information detecting means electrically connected between the phase difference setting means and the inverter circuit, to detect the material of which the object to be heated is formed; and second phase difference changing means electrically connected to the phase difference setting means and the material information detecting means, to change a phase difference value to be set by the phase difference setting means based on said material.

4. The induction heating cooker as set forth in claim 1, further comprising:

phase difference restricting means electrically connected to the phase difference setting means, to restrict a phase difference value to be set by the phase difference setting means, wherein the resonance circuit maintains an inductive state.

5. The induction heating cooker as set forth in claim 1, further comprising:

frequency restricting means electrically connected to the voltage-controlled oscillator, to restrict the magnitude of a frequency to be determined by the voltage-controlled oscillator, so that the frequency is not less than a predetermined value.

6. The induction heating cooker as set forth in claim 1, further comprising:

current restricting means electrically connected between the phase difference setting means and the inverter circuit, to restrict the magnitude of a current passing through the resonance capacitor so that the current does not exceed a predetermined value.

7. The induction heating cooker as set forth in claim 1, wherein:

the phase difference setting means is provided with an initial setting circuit, which gradually decreases the oscillator frequency of the inverter circuit at the start of operation of the voltage-controlled oscillator.

* * * * *